US010640330B2

(12) United States Patent
Krämer

(10) Patent No.: US 10,640,330 B2
(45) Date of Patent: May 5, 2020

(54) SAFETY DEVICES, LIFT SYSTEMS WITH SAFETY DEVICES AND METHODS OF OPERATING LIFT SYSTEMS WITH SAFETY DEVICES

(71) Applicants: ThyssenKrupp Elevator AG, Essen (DE); thyssenkrupp AG, Essen (DE)

(72) Inventor: Michael Krämer, Ostfildern (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 285 days.

(21) Appl. No.: 15/736,601

(22) PCT Filed: Jun. 20, 2016

(86) PCT No.: PCT/EP2016/064209
§ 371 (c)(1),
(2) Date: Dec. 14, 2017

(87) PCT Pub. No.: WO2016/207116
PCT Pub. Date: Dec. 29, 2016

(65) Prior Publication Data

US 2018/0186600 A1 Jul. 5, 2018

(30) Foreign Application Priority Data

Jun. 22, 2015 (DE) ..... 10 2015 211 488

(51) Int. Cl.
*B66B 1/34* (2006.01)
*B66B 5/00* (2006.01)
(Continued)

(52) U.S. Cl.
CPC ..... *B66B 5/0031* (2013.01); *B66B 1/30* (2013.01); *B66B 1/32* (2013.01); *B66B 5/0062* (2013.01);
(Continued)

(58) Field of Classification Search
CPC ..... B66B 5/0031; B66B 1/30; B66B 1/32; B66B 5/0062; B66B 5/0068;
(Continued)

(56) References Cited

U.S. PATENT DOCUMENTS 4,568,909 A * 2/1986 Whynacht ..... B66B 5/0037 187/393
4,785,914 A * 11/1988 Blain ..... B66B 1/24 187/280
(Continued)

FOREIGN PATENT DOCUMENTS

CN 1342129 A 3/2002
DE 102004009250 A 9/2005
(Continued)

OTHER PUBLICATIONS

English translation of International Search Report issued in PCT/EP2016/064209 dated Aug. 31, 2016 (Sep. 8, 2016).
English abstract of DE102012005541.

*Primary Examiner* — Anthony J Salata
(74) *Attorney, Agent, or Firm* — thyssenkrupp North America, LLC.

(57) ABSTRACT

A safety device of a lift system may include a car, an evaluation device, and a measuring device. Conditions where departure from a door zone with an open car door or where impermissible accelerations/speeds are reached within the door zone are identifiable by way of the evaluation device and output signals from the measuring device. In such conditions, a control signal may be generated for braking the car. A safety circuit may be connected to the evaluation device and ensure a first safe zone in a shaft head of a lift shaft during an inspection run. The safety circuit may have a safety switch, and the car may include a tripping means for tripping the safety switch. The safety switch and the tripping means have a first relative position upon which
(Continued)

the first safe zone is based, and entry of the car into the first safe zone during the inspection run is preventable by tripping the safety switch, which leads to generation of the control signal and braking of the car.

19 Claims, 4 Drawing Sheets

(51) Int. Cl.

| | |
|---|---|
| ***B66B 13/22*** | (2006.01) |
| ***B66B 1/30*** | (2006.01) |
| ***B66B 1/32*** | (2006.01) |
| ***B66B 5/02*** | (2006.01) |
| ***B66B 5/04*** | (2006.01) |
| ***B66B 9/00*** | (2006.01) |

(52) U.S. Cl.
CPC ..... *B66B 5/0068* (2013.01); *B66B 5/0093* (2013.01); *B66B 5/02* (2013.01); *B66B 5/04* (2013.01); *B66B 9/00* (2013.01); *B66B 13/22* (2013.01); *B66B 2201/00* (2013.01)

(58) Field of Classification Search
CPC ..... B66B 5/0093; B66B 5/02; B66B 5/04; B66B 9/00; B66B 13/22; B66B 2201/00
USPC ..... 187/247, 277, 284, 286, 287, 291, 391, 187/393
See application file for complete search history.

(56) References Cited

U.S. PATENT DOCUMENTS

| | | | | |
|---|---|---|---|---|
| 6,543,583 | B1 * | 4/2003 | Lence Barreiro | B66B 5/0025 187/316 |
| 6,543,584 | B1 | 4/2003 | Miyakoshi | |
| 7,575,102 | B2 * | 8/2009 | Matsuoka | B66B 5/0093 187/391 |
| 7,743,891 | B2 * | 6/2010 | Tyni | B66B 1/3476 187/393 |
| 7,775,330 | B2 * | 8/2010 | Kattainen | B66B 5/04 187/393 |
| 8,272,482 | B2 * | 9/2012 | Takahashi | B66B 1/32 187/393 |
| 8,365,873 | B2 * | 2/2013 | Viita-Aho | B66B 5/0031 187/314 |
| 8,552,738 | B2 * | 10/2013 | Quinn | B66B 13/22 324/549 |
| 8,807,285 | B2 * | 8/2014 | Kugiya | B66B 13/22 187/301 |
| 8,869,945 | B2 * | 10/2014 | Harkonen | B66B 1/28 187/288 |
| 2005/0230191 | A1 | 10/2005 | Heinzer | |
| 2009/0288920 | A1 | 11/2009 | Kattainen | |

FOREIGN PATENT DOCUMENTS

| | | | |
|---|---|---|---|
| DE | 69938524 | T | 6/2009 |
| DE | 102012005541 | A | 9/2013 |
| EP | 2033927 | A | 3/2009 |
| EP | 2457860 | A | 5/2012 |
| JP | 2006-199404 | A | 8/2006 |
| JP | 2014-506864 | A | 3/2014 |

* cited by examiner

SAFETY DEVICES, LIFT SYSTEMS WITH SAFETY DEVICES AND METHODS OF OPERATING LIFT SYSTEMS WITH SAFETY DEVICES

CROSS REFERENCE TO RELATED APPLICATIONS

This application is a U.S. National Stage Entry of International Patent Application Serial Number PCT/EP2016/064209, filed Jun. 20, 2016, which claims priority to German Patent Application No. DE 10 2015 211 488.0 filed Jun. 22, 2015, the entire contents of both of which are incorporated herein by reference.

FIELD

The present disclosure generally relates to lift systems and safety devices for lift systems.

BACKGROUND

Lift systems have a multiplicity of safety devices in order to prevent an uncontrolled movement of a lift car of the lift system. Here, a distinction is typically drawn between safety devices which are used during a normal run of a lift car of the lift system, and safety devices for maintenance personnel. A normal run is understood to be the typical operation of the lift system when requested by passengers. As opposed thereto, safety devices for maintenance personnel also cover inspection runs. The inspection run of a lift car is understood to be a movement for inspection and maintenance purposes. During an inspection run, for example, maintenance personnel can be located on the roof of the lift car of the lift system.

DE 699 38 524 T2 and EP 2 033 927 A1 disclose various safety devices for inspection runs. In particular, both documents deal with foldable railings on the lift car roof.

EP 2 457 860 A2, on the other hand, discloses a safety device in order to prevent an uncontrolled Thus a need exists for a lift system that both ensures the safety of the passengers during a normal run and also the safety of the maintenance personnel on the lift car roof during an inspection run.

DETAILED DESCRIPTION

Figure 1:
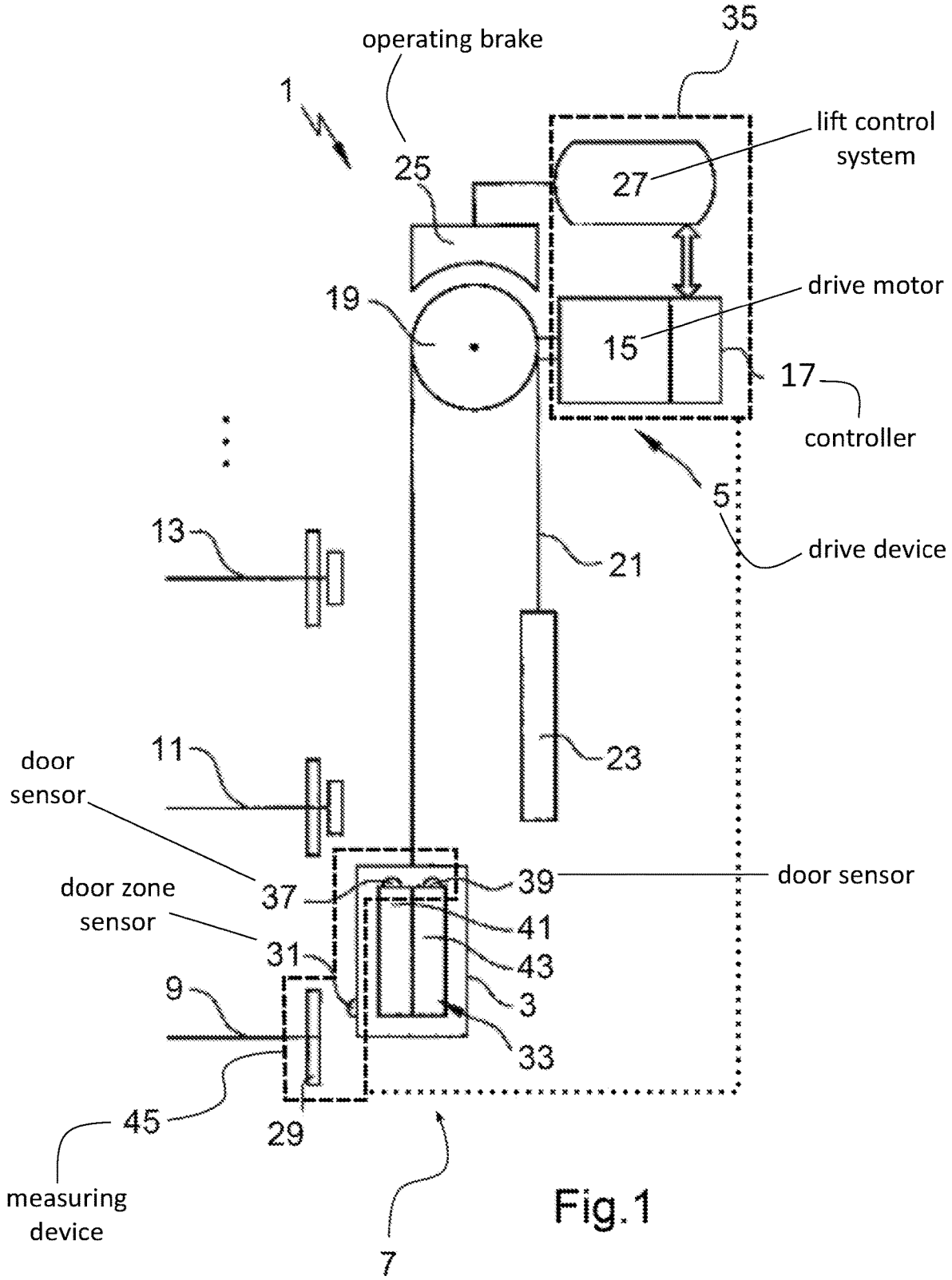
FIG. 1 is a schematic view of an example lift system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

A safety device for a lift system having a lift car may comprise an evaluation device and a measuring device. By means of the evaluation device, by using output signals from the measuring device, departure from at least one door zone with an open lift car door or reaching impermissible accelerations and/or speeds of the lift car within the door zone can be detected and a control signal, on the basis of which the lift car is braked, can be generated. In particular, the safety device can also be developed further such that, by means of the evaluation device, by using output signals from the measuring device, both departure from at least one door zone with an open lift car door and also reaching impermissible accelerations and/or speeds of the lift car within the door zone can be detected and a control signal, on the basis of which the lift car is braked, can be generated.

Furthermore, the safety device has a safety circuit that is connected to the evaluation device in order to ensure a first safe zone in the shaft head of a lift shaft during an inspection run. The safety circuit has a safety switch and the lift car comprises a tripping means for tripping the safety switch. Here, the safety switch and the tripping means have a first position relative to each other in which, by means of their position relative to each other, the first safe zone in the lift shaft is predefined, so that entry of the lift car into the first safe zone during the inspection run can be prevented by tripping the safety switch in that, by means of the evaluation device, on the basis of the tripping of the safety switch, the same control signal, on the basis of which the lift car is braked, can be generated.

This has several advantages. The fact that the safety switch ensures both braking during a normal run with open doors and also braking of the lift car during an inspection run means that the number of safety-relevant components of the lift system can be reduced. According to the building regulations, it is necessary for the lift car to be brought to a standstill by the safety device within a predefined stopping travel in the event of unintended travel with open doors. This stopping travel must be ensured during all the possible states of the lift system, for example with all possible loadings of the lift car. In order to ensure this, the whole of the safety chain between tripping the measuring device, evaluating output signals from the measuring device by an evaluation device, as far as controlling a braking mechanism by the evaluation device and the braking response of the brake mechanism must be checked and calculated separately. For example, any time delay during the evaluation of the output signals leads to an extended stopping travel. This checking and calculation must be carried out for all loading situations since, for example, the braking action of the braking mechanism depends on the state of loading of the lift car. Accordingly, it is likewise necessary that during an inspection run the lift car must be brought to a standstill by the safety device at the correct time, so that at every time a sufficient safety margin remains for the maintenance personnel on the roof of the lift car. For this purpose, the same elaborate calculation and checking of the safety chain is required in order to reliably ensure compliance with the defined stopping travel. The partial combination according to the invention of the two safety chains (from the evaluation unit as far as the braking mechanism) considerably reduces the outlay for the checking and calculation of the corresponding components. Since in both cases (travel with open doors outside the door zone, undesired movement into the shaft head) the evaluation device generates the identical control signal for the braking mechanism, the maximum stopping travel is also identical in both cases.

In addition, a simplification of the certification of the lift system can also result. In accordance with the standards for lift systems, it is necessary for some countries to have specific safety devices certified by independent testing institutes. As a result of the partial combination of the two safety chains, it is possible, where applicable, to obtain simplified certification for the assurance of the inspection travel, since the corresponding components are at least to some extent already satisfied in conjunction with a normal run.

The tripping means for tripping the safety switch is in particular an emergency limit switch cam. This comprises in particular a running track, arranged slightly obliquely with respect to the vertical, which is connected to the lift car. When the lift car moves into the lift head, the safety switch and the emergency limit switch cam interengage. As a result of the slightly inclined position with respect to the vertical, the safety switch is moved more, the more the lift car moves into the lift head. Starting from a specific vertical position of the lift car and therefore of the emergency limit switch cam, the latter then trips the safety switch.

In one refinement of the invention, the control signal is designed to effect deactivation of the drive motor. In particular, the control signal can be suitable to effect a short circuit in the drive motor. This leads to particularly rapid deactivation of the drive motor.

In a further refinement of the invention, the control signal is designed to effect engagement of the operating brake. The operating brake can in particular be approved as a safety brake, such as in gearless drives.

In a development of the invention, the safety circuit is inactive during a normal run. The safety circuit is thus activated only during an inspection run. It can be implemented, for example, by the safety switch and/or the tripping means being variable in their position and being able to have a second position relative to each other. In this second position, a run of the lift car does not lead to tripping of the safety switch even when the entire travel distance is completely utilized. Alternatively, the safety switch can, for example, also be disconnected electrically from the evaluation device, so that the evaluation device does not register any tripping of the safety switch.

The variability of the position can be implemented, for example, by the safety switch or the tripping means being designed to be displaceable. In particular, the tripping means is formed in such a way that it can be displaced in a receptacle on the lift car and can latch in the receptacle both in the first position and in the second position.

In an alternative development, the safety switch and/or the tripping means are variable in their position and can have a second position relative to each other in which, by means of their position relative to each other, a second safe zone in the lift shaft is predefined, so that a lift car can be prevented from moving into the second safe zone during a normal run by tripping the safety switch. In this configuration, the same control signal on the basis of which the lift car is braked can also be generated by the evaluation device on the basis of the tripping of the safety switch. This variant has the additional advantage that the safety circuit is also used during a normal run. It is necessary even during normal runs to provide a second safe zone in the lift head, into which zone the lift car cannot move. The second safe zone, however, has a vertical extent which is lower than the vertical extent of the first safe zone. This is typically tripped by an additional mechanism being provided. Here, this can be, for example, a limit switch on the counterweight buffer. The simultaneous use of the safety circuit for this purpose permits the additional mechanism to be dispensed with.

In a further developed variant, the tripping means for tripping the safety switch can be displaced in the vertical direction with respect to the lift car between the first position and the second position in such a way that the vertical extent of the first safe zone is greater than the vertical extent of the second safe zone. The displacement of the tripping means in the vertical direction is a variant which can be implemented particularly simply in structural terms. In particular, the tripping means can be reached substantially more easily by the maintenance personnel, since it is connected to the lift car. The tripping means can therefore be moved from the first to the second position in a simple way by the maintenance personnel. If, for example, the tripping means is an emergency limit switch cam, the displaceability can be implemented by simply pulling up and latching the emergency limit switch cam in the second position.

In a specific refinement of the invention, the safety circuit additionally comprises a switch for monitoring the position of the tripping means. The switch likewise has a signal connection to the evaluation device. In the event that the switch is tripped on account of an unintended displacement of the tripping means, the evaluation device generates a control signal, on the basis of which the lift car is braked. This ensures that, in the event of an inadvertent displacement of the tripping means, the lift system is switched off, since the lift system is no longer in the safe operating mode.

The invention also relates to a lift system having an above-described safety device. This has the same advantages which have been explained above with reference to the safety device.

In a specific embodiment of the lift system, the lift car has a railing on a lift car roof, which can be displaced in the vertical direction between a first position and a second position. The railing is intended to prevent maintenance personnel being located too close to the edge of the car roof during an inspection run. To some extent, the attachment of such a railing is required because of the building regulations. The adjustability has the advantage that the railing firstly has a sufficient height during an inspection run, so that its safety purpose can be satisfied. On the other hand, the lift car can nevertheless move far into the lift head during a normal run without this being prevented by the height of the railing.

In a specific development of the lift system, the safety circuit comprises a further switch, which monitors the position of the railing. For this purpose, the switch has a signal connection to the evaluation unit. This has the advantage that, in the event of an unintended displacement of the railing (for example from the second position in the direction of the first position), the switch is tripped. On account of the tripping of the switch, the evaluation device then generates a control signal, on the basis of which the lift car is braked. This prevents the inspection run being continued in an unsafe operating mode.

In another development of the lift system, the railing is coupled to the tripping means in such a way that the railing and the tripping means are displaceable only jointly between the first and the second position. In particular, the coupling can consist in the tripping means being fixed to the railing. The coupling has the advantage that, before the start of an inspection run, the maintenance personnel can move both the railing and the tripping means from the first to the second position by means of only one action. In this way, the start of the maintenance work is accelerated.

The invention also relates to a method for operating a lift system having a lift car and a prescribed safety device. In a normal mode, on the basis of an output signal from the measuring device, the evaluation device detects the departure from at least one door zone with an open lift car door or the reaching of impermissible accelerations and/or speeds of the lift car within the door zone. As soon as such an unintended run is detected, the evaluation device generates a control signal, on the basis of which the lift car is braked. Here, the normal mode is understood to be the usual operation of the lift system at the request of passengers. During the normal mode, normal runs are thus carried out.

In the inspection mode, on the other hand, the evaluation device detects tripping of the safety switch and, on the basis thereof, generates the same control signal, so that the lift car is braked. An inspection mode is understood to be an operation of the lift system for inspection and maintenance purposes. No passengers are transported in the inspection mode. During the inspection mode, inspection runs in which, for example, maintenance personnel can be located on the roof of the lift, are accordingly carried out.

The method has the same advantages as have been explained above with reference to the safety device.

FIG. 1 shows, schematically, a lift system 1 comprising a lift car 3, which can be moved upward and downward in the vertical direction in a lift shaft 7 by means of a drive device 5, wherein it can stop at various stopping points, of which only three stopping points 9, 11, 13 are illustrated in FIG. 1, in order to be loaded and unloaded.

The drive device 5 comprises a drive motor 15 which is controlled by a controller 17, wherein a supply voltage is provided to the drive motor 15 via the controller 17. In addition, the drive device 5 comprises a drive pulley 19, which is set rotating by the drive motor 15. A cable 21 is led around the drive pulley 19 and connects the lift car 3 to a counterweight 23. The drive pulley 19 is assigned an operating brake 25 which, just like the controller 17, is connected to a lift control system 27.

At each stopping point 9, 11 and 13, zone flags 29 which can be detected by a door sensor 31 are arranged in the lift shaft 7. The door sensor 31 is fixed to the lift car 3 and connected to the lift control system 27. The zone flag 29 predefines a door zone. As long as the door sensor 31 detects the zone flags 29, the lift car 3 is located within the door zone.

As already mentioned, the lift car 3 can be moved in the lift shaft 7 by means of the drive device 5. For the purpose of loading and unloading, the lift car 3 can assume a position flush with a stopping point 9, 11, 13. The weight of the lift car 3 changes as a result of the loading and unloading. This can lead to the lift car 3 changing its position slightly relative to the stopping point 9, 11, 13. It is then possible for the position of the lift car 3 relative to the respective stopping point 9, 11, 13 to be readjusted by the drive device 5 being activated. The adjustment movement is carried out here at very slow speed and very low acceleration within the door zone which is predefined by the zone flag 29.

As the lift car 3 approaches a stopping point 9, 11, 13, the lift car door 33 can already be opened even before the lift car 3 has reached its flush position. The lift car door 33 can be opened as soon as the door zone sensor 31 detects the zone flag 29.

In the example described, in each case exactly one door zone is defined per stopping point 9, 11, 13. Alternatively, it is also known to define multiple door zones per stopping point. For example, a first door zone can be defined for the adjustment movement and a second door zone for the movement to a stopping point.

For safety reasons, it is necessary that the lift car 3 does not leave the door zone with the lift car door 33 open. In addition, impermissible accelerations and/or speeds of the lift car 3 must be prevented within the to door zone. This is carried out by means of the safety device. The safety device comprises an evaluation unit 35, which is formed by the lift control system 27 and the control device 17. Lift control system 27 and controller 17 are connected to each other by means of a signal connection (bidirectional electric connection) for this purpose. If the lift control system 27 receives from the door zone sensor 31 the signal that the lift car 3 is leaving the door zone, and if the lift control system 27 simultaneously receives from the door sensors 37 and/or 39 the signal that at least one door leaf is not closed, then the evaluation device 35 generates a control signal, on the basis of which the lift car 3 is braked. For this purpose, the evaluation device 35 has a signal connection to the operating brake 25 and the drive device 5. The zone flag 29, the door zone sensor 31 and the door sensors 37, 39 are thus part of the measuring device 45 for monitoring the lift car state.

The consequence of the control signal is that the operating brake 25 is activated and, in addition, that the drive motor 15 is switched off. It is likewise possible that the control signal merely activates the operating brake 25 or merely switches off the drive motor 15. Other known braking methods for a lift car 3 on the basis of the control signal are likewise possible.

Figure 2:
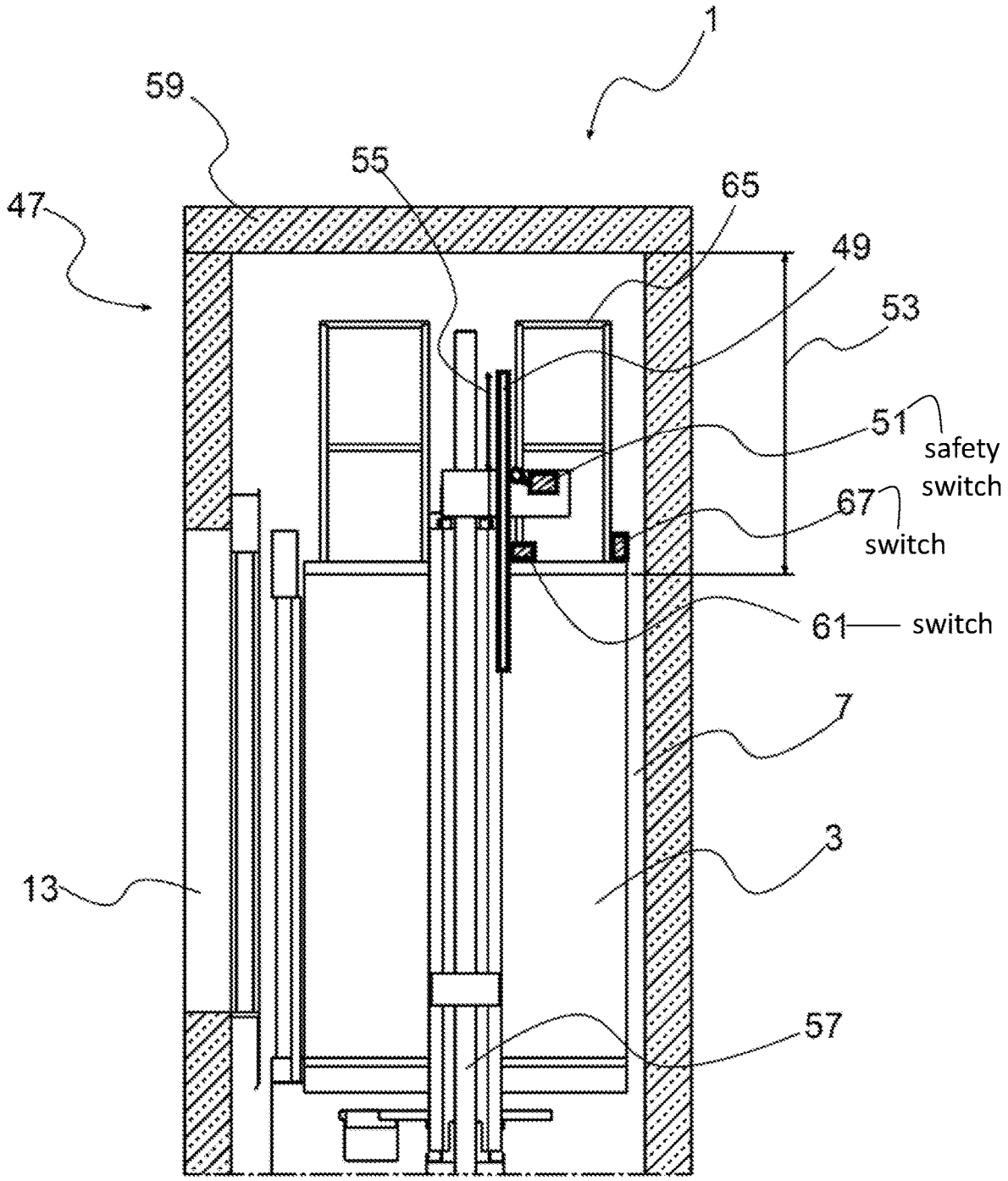
FIG. 2 is a detailed view of an example lift head during an inspection run.

FIG. 2 shows an illustration of the shaft head 47 of a lift shaft 7. The lift car 3 is located in the lift shaft 7. The lift car 3 can be moved in the lift shaft 7 along the guide rails 57. In the operating mode illustrated in FIG. 2, the lift car 3 is carrying out an inspection run. Arranged on the lift car 7 is an emergency limit switch cam 49. As it moves into the lift head 47, the emergency limit switch cam 49 trips the safety switch 51, which is connected to the shaft wall in the shaft head 47. The safety switch 51 is part of a safety circuit which is connected to the evaluation device 35. On the basis of the tripping of the safety switch 51, the evaluation device 35 generates the control signal, on the basis of which the lift car 3 is braked. This leads to a first safe zone 53, into which the lift car 3 cannot move during the inspection run, being predefined in the shaft head 47. Maintenance personnel who are located on the lift car 3 during the inspection run are thus secured against being crushed between lift car 3 and lift shaft end 59. As opposed to a normal run, during an inspection run a considerably greater safety margin above the lift car roof must be ensured, since maintenance personnel can be located on the lift car roof. Here, however, it is necessary to take into account the fact that the lift car still travels a certain stopping travel 55 between the tripping of the safety switch 51 and the complete standstill of the lift car 3. In order to be able to reliably prevent crushing of maintenance personnel, the length of the stopping travel 55 must be known exactly and also reproducible. All the components which influence the length of the stopping travel 55 must be determined and checked exactly. To some extent, special tripping or separate certification of the components is also required for this purpose. This relates in particular to the evaluation device 35 and all the components which contribute to the braking of the lift car 3 (in the above example, these are the operating brake 25, the drive motor 15 and the signal connection to said components). According to the invention, the evaluation device 35 generates the same control signal with which the lift car 3 is also braked when travelling with open door leaves outside a door zone. This has the advantage that the same components which, for safety reasons, are subjected to a special check or separate certification can be used for two fundamentally different applications. In this way, the number of specially checked components can be kept lower.

Figure 3:
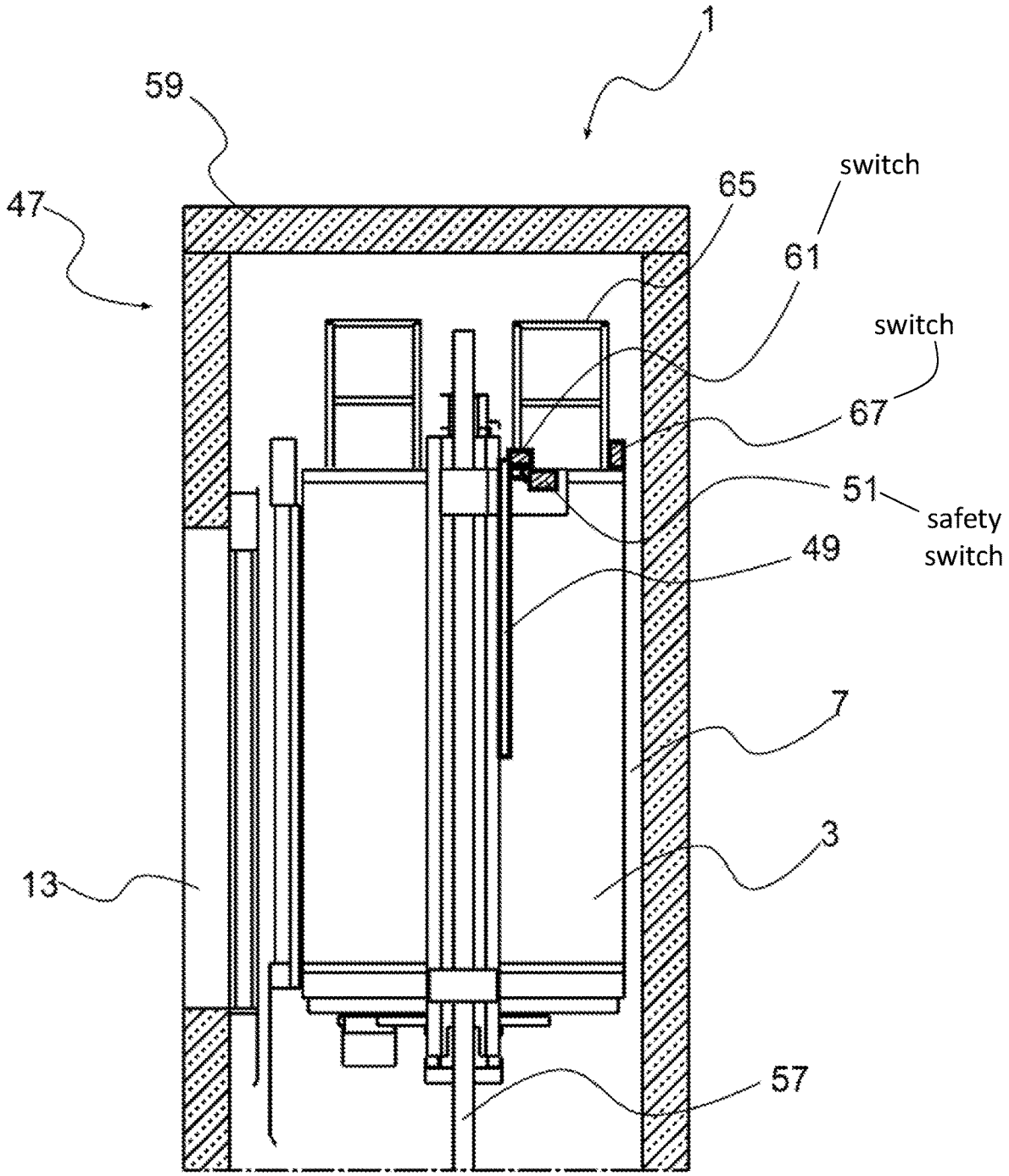
FIG. 3 is a detailed view of an example lift head during a normal run.

FIG. 3 shows the same shaft head 47 during a normal run of the lift car 3. As compared with the illustration in FIG. 2, the emergency limit switch cam 49 is offset downward in the vertical direction in relation to the lift car 3. The emergency limit switch cam 49 and the safety switch 51 thus have a second position relative to each other. In this second position, the lift car 3 can move substantially further into the lift head 47 and therefore into the first safe zone without effecting any tripping of the safety switch 51. The distance between lift car 3 and lift shaft end 59 is considerably lower than in the illustration according to FIG. 2. The end position of the lift car 3 is in this case ensured by an additional mechanism. Here, this can be, for example, a known limit switch on the counterweight buffer. The safety circuit with the safety switch 51 is thus inactive.

In order to prevent the emergency limit switch cam 49 from inadvertently leaving the first position during an inspection run, so that movement into the first safe zone 53 can no longer be safely prevented, the safety circuit has a switch 61 which continuously monitors the position of the emergency limit switch cam 49. In the event of a displacement of the emergency limit switch cam 49, the evaluation device 35 generates a control signal, on the basis of which the lift car 3 is braked, on account of the tripping of the switch 61.

Before the start of an inspection run, the maintenance personnel go onto the roof of the lift car 3 and move the emergency limit switch cam 49 from the second position into the first position. In this way, the switch 61 is put into effect, the safety circuit is activated and the lift car 3 is prevented from moving into the first safe zone. Only after activation of the safety circuit is the performance of an inspection run possible. Following the conclusion of the maintenance work, the emergency limit switch cam 49 is brought into the second position again, so that the lift car 3 can once more move into the first safe zone.

Figure 4:
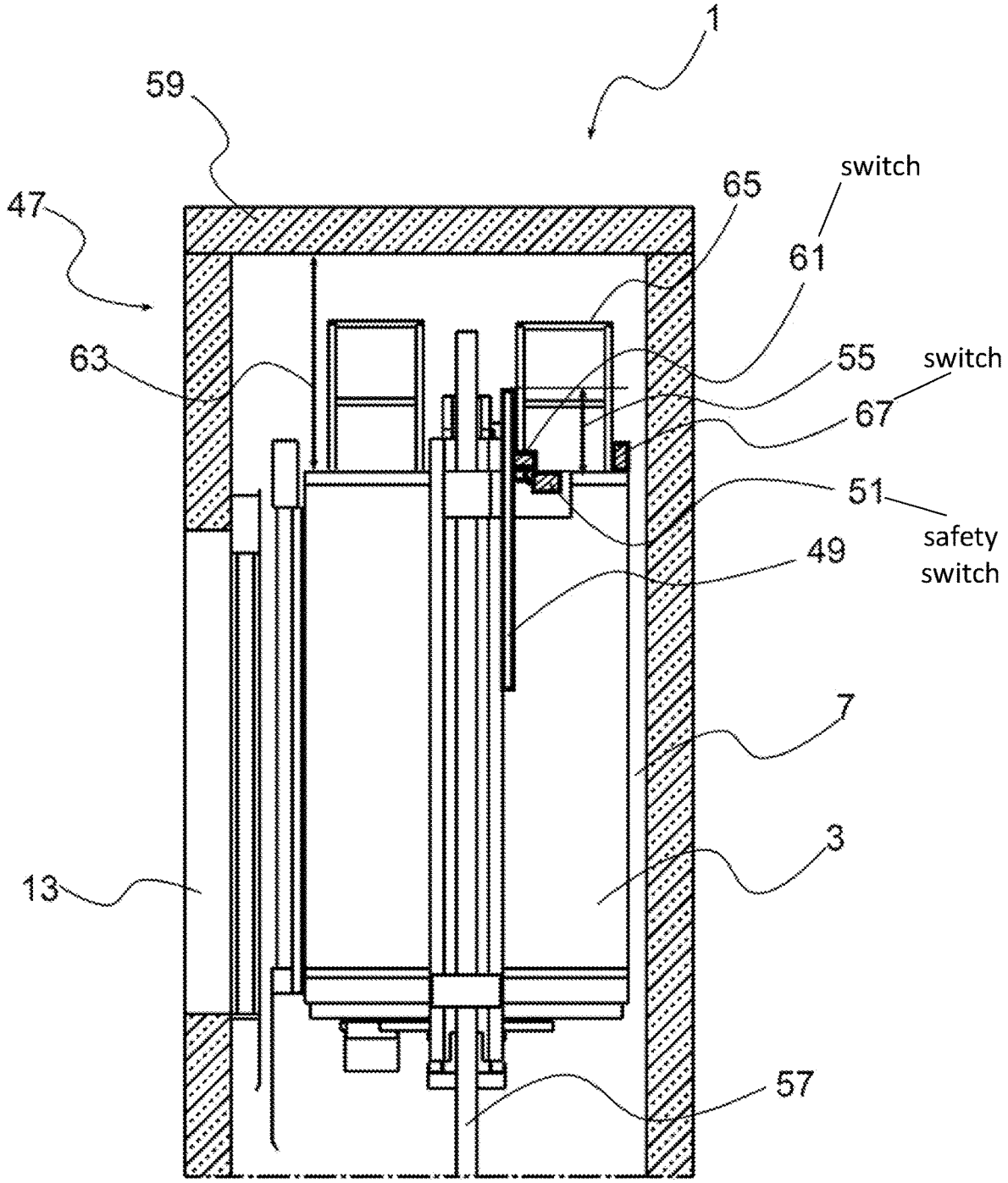
FIG. 4 is a detailed view of another example lift head during a normal run.

FIG. 4 shows an alternative variant of the lift system 1 during a normal run of the lift car 3. As compared with the illustration in FIG. 2, here too the emergency limit switch cam 49 is offset downward in relation to the lift car 3. Emergency limit switch cam 49 and the safety switch 51 thus have a second position relative to each other. As opposed to the variant illustrated in FIG. 3, the safety circuit is, however, also active during a normal run and defines the end position of the lift car 3 in the lift shaft 7. Consequently, no additional mechanism is needed to ensure the end position of the lift car 3. In the second position, the safety switch 51 and the emergency limit switch cam 49 predefine a second safe zone 63 in the lift shaft by means of their position relative to each other, so that the lift car 3 is prevented from moving into the second safe zone 63 during a normal run by tripping the safety switch 51. Here, the first safe zone 53 has a vertical extent which is greater than the vertical extent of the second safe zone 63, as can be seen clearly by means of a comparison of FIGS. 2 and 4. The same emergency limit switch cam 49 which prevents the lift car 3 from moving into the first safe zone 53 during an inspection run (FIG. 2) also prevents the lift car 3 from moving into the second safe zone 63 during a normal run (FIG. 4). In both cases, the emergency limit switch 49 trips the safety switch 51, whereupon the evaluation device 35 generates the control signal on the basis of which the lift car 3 is braked.

In a further-developed embodiment of the invention, the lift car 3 has a railing 65 on the lift car roof (likewise illustrated in FIGS. 2-4). Such a railing 65 can be absolutely necessary during an inspection run, because of building regulations. The railing 65 can, for example, be designed to be foldable, so that it is folded out only during an inspection run, or can be designed to be variable in height, as illustrated in FIGS. 2-4. During an inspection run (FIG. 2), the railing 65 is in a first position, and thus prevents the maintenance personnel from moving too close to the edge of the lift car roof, and thus ensures that they do not fall off. During a normal run (FIG. 3 or FIG. 4), the railing 65 is in a second position, in which it has a considerably lower vertical extent. Therefore, the lift car can move considerably further into the lift head than would be possible with the railing in the first position.

In order to prevent the railing 65 from inadvertently leaving the first position during an inspection run, so that the safety of the maintenance personnel can no longer be adequately ensured, the safety circuit has a circuit 67 which continuously monitors the position of the railing 65. In the event of a displacement of the railing 65, the evaluation device 35 generates a control signal, on the basis of which the lift car 3 is braked, on account of the tripping of the switch 67.

Before the start of an inspection run, the maintenance personnel go onto the roof of the lift car 3 and move the railing 65 from the second position into the first position. In this way, the switch 67 is tripped, the safety circuit activated and the lift car 3 is prevented from moving into the first safe zone 53. Only after the safety circuit has been activated is the performance of an inspection run possible. Following the conclusion of the maintenance work, the railing 65 is brought into the second position again, so that the lift car 3 can once more move into the first safe zone.

LIST OF DESIGNATIONS

Lift system 1
Lift car 3
Drive device 5
Lift shaft 7
Stopping point 9
Stopping point 11
Stopping point 13
Drive motor 15
Controller 17
Drive pulley 19
Cable 21
Counterweight 23
Operating brake 25
Lift control system 27
Zone flag 29
Door zone sensor 31
Lift car door 33
Evaluation device 35
Door sensor 37
Door sensor 39
Door leaf 41
Door leaf 43
Measuring device 45
Shaft head 47
Emergency limit switch cam 49
Safety switch 51

First safe zone 53
Stopping travel 55
Guide rail 57
Shaft end 59
Switch 61
Second safe zone 63
Railing 65
Switch 67

What is claimed is:

1. A safety device of a lift system having a lift car, the safety device comprising:

an evaluation device;

a measuring device, wherein by way of the evaluation device and output signals from the measuring device, conditions where the lift car departs from at least one door zone with an open door, where the lift car reaches an impermissible acceleration within the at least one door zone, or where the lift car reaches an impermissible speed within the at least one door zone are detectable and a control signal for braking the lift car is generated; and a safety circuit that is connected to the evaluation device to ensure a first safe zone in a shaft head of a lift shaft during an inspection run, wherein the safety circuit includes a safety switch and the lift car includes tripping means for tripping the safety switch, wherein the safety switch and the tripping means have a first position relative to each other based on which the first safe zone is defined, so that the lift car can be prevented from moving into the first safe zone during the inspection run by tripping the safety switch, which causes the evaluation device to generate the control signal for braking the lift car.

2. The safety device of claim 1 further comprising a drive motor, wherein deactivation of the drive motor is effected by the control signal.

3. The safety device of claim 1 further comprising an operating brake, wherein engagement of the operating brake is effected by the control signal.

4. The safety device of claim 1 wherein the safety circuit is inactive during a normal run.

5. The safety device of claim 1 wherein a position of at least one of the safety switch or the tripping means is variable, wherein the safety switch and the tripping means have a second position relative to each other based on which a second safe zone in the lift shaft is defined, so that the lift car can be prevented from moving into the second safe zone during a normal run by tripping the safety switch, which causes the evaluation device to generate the control signal for braking the lift car.

6. The safety device of claim 5 wherein the tripping means is displaceable in a vertical direction with respect to the lift car between the first position and the second position such that a vertical extent of the first safe zone is greater than a vertical extent of the second safe zone.

7. The safety device of claim 1 wherein the safety circuit comprises a switch for monitoring a position of the tripping means.

8. A lift system comprising:

a lift car that is movable in a lift shaft; and a safety device that includes an evaluation device, a measuring device, wherein by way of the evaluation device and output signals from the measuring device, conditions where the lift car departs from at least one door zone with an open door, where the lift car reaches an impermissible acceleration within the at least one door zone, or where the lift car reaches an impermissible speed within the at least one door zone are detectable and a control signal for braking the lift car is generated, and a safety circuit that is connected to the evaluation device to ensure a first safe zone in a shaft head of a lift shaft during an inspection run, wherein the safety circuit includes a safety switch and the lift car includes tripping means for tripping the safety switch, wherein the safety switch and the tripping means have a first position relative to each other based on which the first safe zone is defined, so that the lift car can be prevented from moving into the first safe zone during the inspection run by tripping the safety switch, which causes the evaluation device to generate the control signal for braking the lift car.

9. The lift system of claim 8 further comprising a drive motor, wherein deactivation of the drive motor is effected by the control signal.

10. The lift system of claim 8 further comprising an operating brake, wherein engagement of the operating brake is effected by the control signal.

11. The lift system of claim 8 wherein the safety circuit is inactive during a normal run.

12. The lift system of claim 8 wherein a position of at least one of the safety switch or the tripping means is variable, wherein the safety switch and the tripping means have a second position relative to each other based on which a second safe zone in the lift shaft is defined, so that the lift car can be prevented from moving into the second safe zone during a normal run by tripping the safety switch, which causes the evaluation device to generate the control signal for braking the lift car.

13. The lift system of claim 12 wherein the tripping means is displaceable in a vertical direction with respect to the lift car between the first position and the second position such that a vertical extent of the first safe zone is greater than a vertical extent of the second safe zone.

14. The lift system of claim 12 wherein the lift car includes a railing that is disposed on a lift car roof and is displaceable in the vertical direction between a first position and a second position.

15. The lift system of claim 14 wherein the safety circuit comprises a switch that monitors a position of the railing.

16. The lift system of claim 14 wherein the railing is coupled to the tripping means such that the railing and the tripping means are displaceable only jointly between the first position and the second position.

17. A method for operating a lift system having a lift car and a safety device that comprises an evaluation device; a measuring device; and a safety circuit that is connected to the evaluation device to ensure a first safe zone in a shaft head of a lift shaft in an inspection mode, wherein the safety circuit includes a safety switch and the lift car includes tripping means for tripping the safety switch, wherein the safety switch and the tripping means have a first position relative to each other based on which the first safe zone is defined, the method comprising:

in a normal mode detecting based on output signals from the measuring device conditions where the lift car departs from at least one door zone with an open car door, where the lift car reaches an impermissible acceleration within the at least one door zone, or where the lift car reaches an impermissible speed within the at least one door zone, and generating a control signal for braking the lift car when any of the conditions is detected; and in the inspection mode generating the control signal for braking the lift car based on tripping of the safety switch, which prevents the lift car from moving into the first safe zone.

18. The method of claim 17 further comprising deactivating a drive motor upon generation of the control signal.

19. The method of claim 17 further comprising engaging an operating brake upon generation of the control signal.

* * * * *